US007908980B2

(12) United States Patent
Schmidt et al.

(10) Patent No.: US 7,908,980 B2
(45) Date of Patent: Mar. 22, 2011

(54) PALLET HAVING SPACERS MADE OF ELECTRICALLY CONDUCTIVE PLASTIC MATERIAL AND SPACERS MADE OF NON-ELECTRICALLY CONDUCTIVE PLASTIC MATERIAL

(75) Inventors: Klaus-Peter Schmidt, Bonn (DE); Detlev Weyrauch, Kreuzau-Untermaubach (DE); Dietmar Przytulla, Kerpen (DE); Ernst Wurzer, Königswinter (DE)

(73) Assignee: Mauser-Werke GmbH, Brühl (DE)

( * ) Notice: Subject to any disclaimer, the term of this patent is extended or adjusted under 35 U.S.C. 154(b) by 316 days.

(21) Appl. No.: 12/162,041

(22) PCT Filed: Dec. 5, 2006

(86) PCT No.: PCT/EP2006/011623

§ 371 (c)(1),
(2), (4) Date: Jul. 24, 2008

(87) PCT Pub. No.: WO2007/087857

PCT Pub. Date: Aug. 9, 2007

(65) Prior Publication Data

US 2009/0000525 A1 Jan. 1, 2009

(30) Foreign Application Priority Data

Jan. 24, 2006 (DE) ..... 20 2006 001 222 U

(51) Int. Cl.
*B65D 19/38* (2006.01)

(52) U.S. Cl. ..... 108/57.25; 108/57.32; 108/51.11

(58) Field of Classification Search ..... 108/57.25, 108/55.1, 55.3, 901, 902, 57.32, 57.31, 57.33, 108/57.24, 57.22; 206/386; 220/4.12, 3.4, 485, 495.01, 9.1, 9.4
See application file for complete search history.

(56) References Cited

U.S. PATENT DOCUMENTS

| | | | | |
|---|---|---|---|---|
| 4,727,452 | A * | 2/1988 | Brownlee | 361/224 |
| 5,365,858 | A | 11/1994 | Kuhns | |
| 5,437,384 | A * | 8/1995 | Farrell | 220/9.4 |
| 5,634,561 | A * | 6/1997 | Pfeiffer | 206/386 |
| 6,050,437 | A | 4/2000 | Schütz | |
| 6,719,164 | B2 * | 4/2004 | Maschio | 220/9.4 |
| 7,042,695 | B2 * | 5/2006 | Przytulla et al. | 361/215 |
| 7,159,718 | B2 * | 1/2007 | Cassina | 206/386 |
| 7,210,594 | B2 * | 5/2007 | Schutz | 220/1.6 |
| 7,559,431 | B2 * | 7/2009 | Schutz | 220/1.6 |
| 7,740,474 | B2 * | 6/2010 | Scheibel et al. | 432/261 |
| 2003/0196923 | A1 * | 10/2003 | Decroix | 206/386 |
| 2003/0230580 | A1 * | 12/2003 | Schutz | 220/9.4 |
| 2004/0089659 | A1 | 5/2004 | Schutz | |

FOREIGN PATENT DOCUMENTS

| | | |
|---|---|---|
| DE | 201 07 962 U1 | 6/2002 |
| DE | 101 61 693 A1 | 7/2003 |

* cited by examiner

*Primary Examiner* — José V Chen
(74) *Attorney, Agent, or Firm* — Henry M. Feiereisen; Ursula B. Day

(57) ABSTRACT

A pallet for a pallet container for storing and for transporting liquid contents has an upper deck made of profiled sheet steel and a substructure having a plurality of plastic feet or runners. The pallet is grounded electrically. In order to ensure a reliable electrical discharge (electrical grounding) of, for example, electrostatic charging, accompanied by the properties of a high resistance to mechanical loading, fewer than half the plastic feet or runners are made of plastic material which is electrically conductive and more than half the plastic feet or runners are made of plastic material which is not electrically conductive.

11 Claims, 3 Drawing Sheets

PALLET HAVING SPACERS MADE OF ELECTRICALLY CONDUCTIVE PLASTIC MATERIAL AND SPACERS MADE OF NON-ELECTRICALLY CONDUCTIVE PLASTIC MATERIAL

BACKROUND OF THE INVENTION

The invention relates to a pallet for a pallet container for storing and transporting liquid contents, in particular flammable and explosive contents. The pallet includes an upper deck made of profiled steel sheet and a substructure of several plastic feet or runners and is provided with means to electrically ground the entire pallet.

State-of-the-Art

Pallet containers or combination-IBCs (IBC=Intermediate Bulk Container) of the disclosed type are used for transporting liquids. They have preferably a fill volume of 1000 liters and include a bottom pallet, a stable outer support jacket made of metal tubing and secured on the pallet, and a relatively thin-walled inner plastic container made of HD-PE which is in close contact with the support jacket and has a top fill opening and a bottom outlet fitting. For the intended use for flammable or explosive contents, the individual components of the pallet container must be constructed to be electrically conducting, to ensure that the content is grounded and to reliably prevent electric discharge accompanied by dangerous spark formation. The inner plastic container has typically a thin electrically conducting plastic layer and is electrically connected with the contents, for example, via a pump pipe, which extends into the liquid content and is also electrically conducting, or via a corresponding electrode rod. Unlike ordinary plastic pallets, the lattice framework made of metal pipe and a pallet made of steel tubing are inherently electrically conducting.

It is known to make plastic pallets overall electrically conducting by adding carbon (carbon black). To attain a sufficiently high electrical conductivity, admixture of about 5-8% of carbon black into the plastic matrix is required. Carbon black is relatively expensive, on one hand, and the carbon black mixed into the plastic matrix significantly diminishes the mechanical properties of the produced blackened products, on the other hand. In particular, the fracture resistance under impact decreases rapidly.

Pallet containers certified for storing and transporting flammable or explosive liquid contents must undergo a special regulatory approval test. During the test, the containers are subjected to high stress that causes significant plastic deformations, for example when the containers are dropped vertically or diagonally from a height of about 1.9 m on a steel plate. Still, content must not leak out and the cage jacket must after impact still be firmly connected with the pallet. The pallet must remain functional to the extent that the deformed pallet container can still be lifted and transported by a forklift.

SUMMARY OF THE INVENTION

It is therefore an object of the present invention to provide a pallet for a pallet container which obviates the disadvantages of conventional pallets and provides in a simple and cost-effective manner the advantageous properties of electric discharge (electrical grounding) while still being able to withstand high mechanical stress.

The object is attained by a pallet for a pallet container for storing and transporting liquid contents, in particular for flammable or explosive contents, wherein the pallet includes an upper deck of profiled sheet steel and a substructure of several plastic feet or runner, and is provided with means for grounding the entire pallet, wherein less than half of the plastic feet or runners are made of electrically conductive plastic material and more than half of the plastic feet or runners are made of plastic material which is not electrically conductive.

By the simple measure that less than half of the plastic feet or runners are made of electrically conductive plastic material and more than half of the plastic feet or runners are made of plastic material which is not electrically conductive, the total mechanical load-bearing capacity of the pallet is significantly enhanced, while at the same time ensuring that the entire pallet container is electrical grounded via the bottom pallet.

According to an embodiment of the invention, at least one plastic foot or plastic runner is made of electrically conductive plastic material. By making the majority of the plastic runners or plastic feet of non-electrically conducting plastic material, a large quantity of otherwise required, comparatively expensive, carbon black is conserved.

According to another embodiment of the invention, only the center runner or the center feet including the innermost center foot are made of electrically conductive plastic material, whereas the two outer runners or the corner feet, including the center foot with drip pan below the outlet fitting of the inner plastic container are made of plastic material which is not electrically conductive.

When handling filled pallet containers with forklifts, the corner regions of the bottom pallet (corner feet) in particular are subjected to high stress during the normal rough operating conditions, because when the pallet containers are aligned on the designated placement spaces, the entire container is typically pushed into the final position by applying the forks against the corner feet of the pallet. This frequently causes damage, which may prevent a pallet container damaged in this way from being reused several times, with the result that the damaged pallet container must be separated during the next reconditioning. This may occur more frequently when the corner feet of the pallet are also made of a fragile electrically conducting plastic material.

According to another embodiment of the invention, only the center feet in two opposing sidewalls are made of electrically conductive plastic material, whereas the other feet, including the innermost center foot and the center foot below the outlet fitting of the inner plastic container, are made of plastic material which is not electrically conductive. It is particularly important that the center foot with drip pan below the outlet fitting of the inner plastic container is made of a non-electrically conducting plastic material, which should have relatively good elastic properties, so that the stability of the pallet container, in particular for the critical drop test onto the side edge of the bottom pallet with the outlet fitting (diagonal drop) is not diminished.

According to a preferred embodiment of the invention, only the center foot in the sidewall facing the outlet fitting of the inner plastic container is made of electrically conductive plastic material, whereas the other feet, including the center foot below the outlet fitting of the inner plastic container as well as the optional innermost center foot, are made of plastic material which is not electrically conductive. This produces the greatest cost reduction (slight quantity of carbon black for only one center foot) and significantly increases the mechanical stiffness. This variant is particularly advantageous when a steel tube which peripherally extends below the outer feet is provided for increasing of the stability of the pallet. The entire pallet container is then always securely grounded, for example, even when uneven support surface is involved.

According to a further embodiment of the invention, only the innermost center foot which is spaced from all side edges of the pallet may be made of electrically conductive plastic material, whereas all other feet on the side edges of the pallet are made of plastic material which is not electrically conductive. This optimally protects the innermost center foot against stress during the drop test and during daily handling with the forks of the fork lift.

Advantageously, the manufacturer, the customer and the reconditioner should be able to recognize immediately that the entire pallet is constructed electrically conducting and grounded. To this end, the plastic runner or the plastic center foot or feet is/are made of electrically conductive plastic material that includes a marking indicating the electrically conductive property, for example "Conductive Plastic Material for Grounded Pallet".

The bottom pallet according to the invention is characterized by the following advantages:

- Electrically discharging with assurance of reliable grounding,
- Less demand for and consumption of expensive carbon black,
- Admixture of a smaller quantity of carbon black into the plastic material,
- Significant improvement of the mechanical strength compared to plastic pellets which are entirely made out of electrically conductive material,
- No additional measures, such as grounding wire (which can be easily torn off by the fork of a forklift) or additional complicated, continuous, electrically conducting fastening bolts, are required.

BRIEF DESCRIPTION OF THE DRAWING

The pallet of the invention will now be described in more detail with reference to exemplary embodiments schematically depicted in the drawings, which show in.

DETAILED DESCRIPTION OF THE PREFERRED EMBODIMENTS

Figure 1:
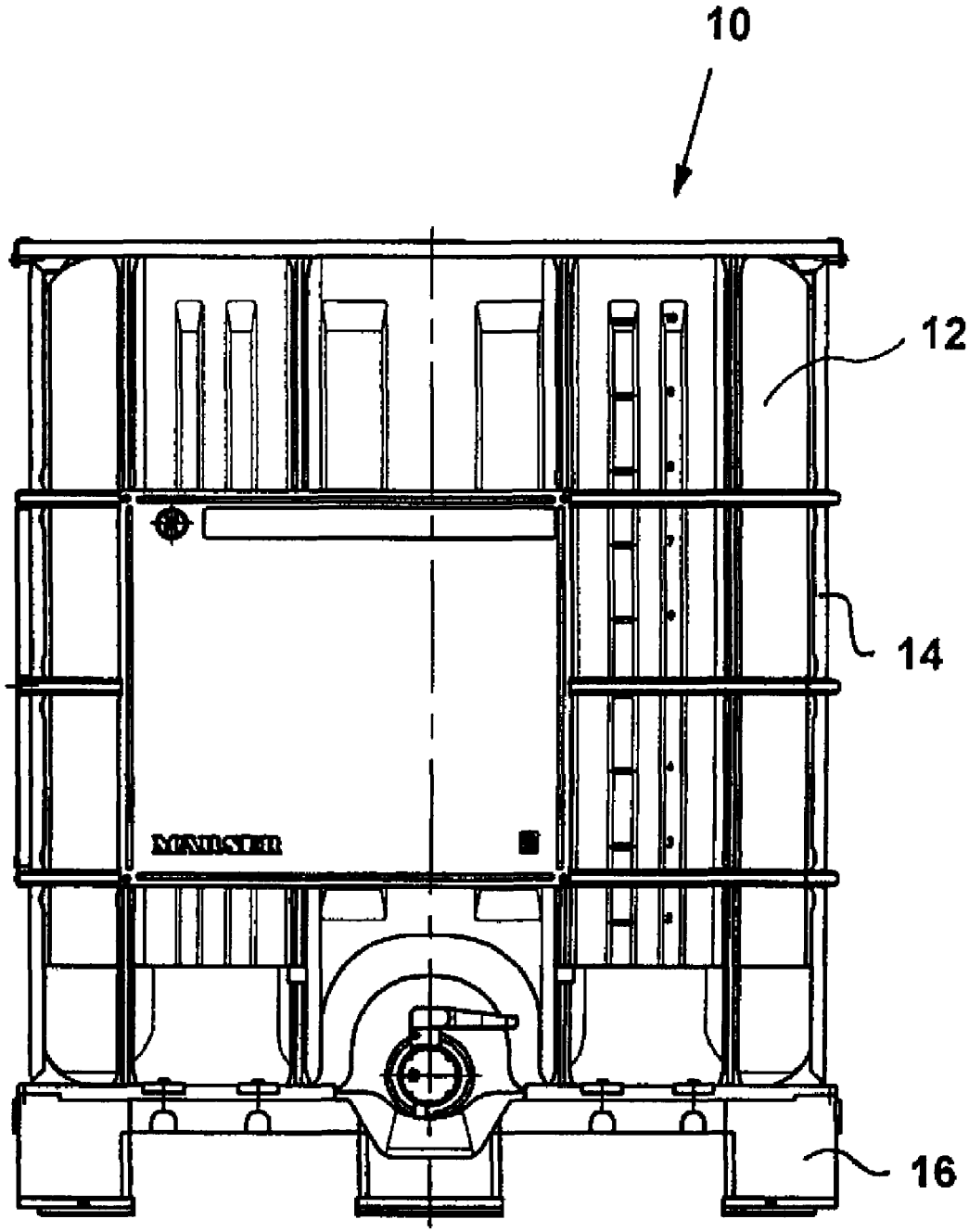
FIG. 1 a front view of a pallet container with a bottom pallet according to the invention, FIG. 2 an isometric view of an embodiment of a bottom pallet according to the invention, FIG. 3 the substructure of the bottom pallet according to FIG. 2, FIG. 4 the substructure of another embodiment of a bottom pallet according to the invention, and FIG. 5 an electrically conducting plastic center foot of the bottom pallet.

FIG. 1 shows a pallet container 10, which is particularly suited for use with flammable liquids, with a bottom pallet 16, a cuboidal inner plastic container 12 with a closable top fill opening and a bottom outlet opening with a discharge fitting as well as a lattice framework 14 surrounding the inner container 12 and formed of vertical and horizontal metallic rods, whereby the inner container is made overall of translucent or a transparent plastic material and coated with a thin outer layer of electrically conducting or permanently antistatic plastic, so that the fill level of the liquid content can be easily determined. Advantageously, the inner plastic container 12 is also provided with an outlet fitting that is antistatic and/or enables electrical discharge. A forklift can handle the bottom pallet 16 of the pallet container 10, which is configured as reusable container, from all four sides.

Figure 2:
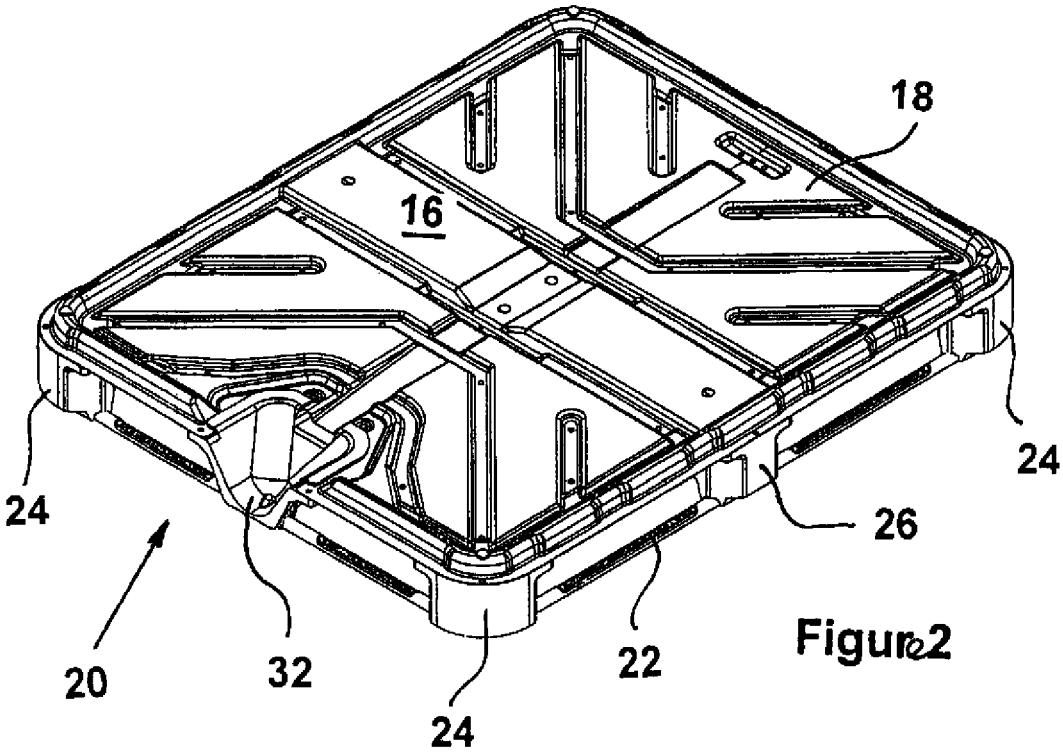
Figure 3:
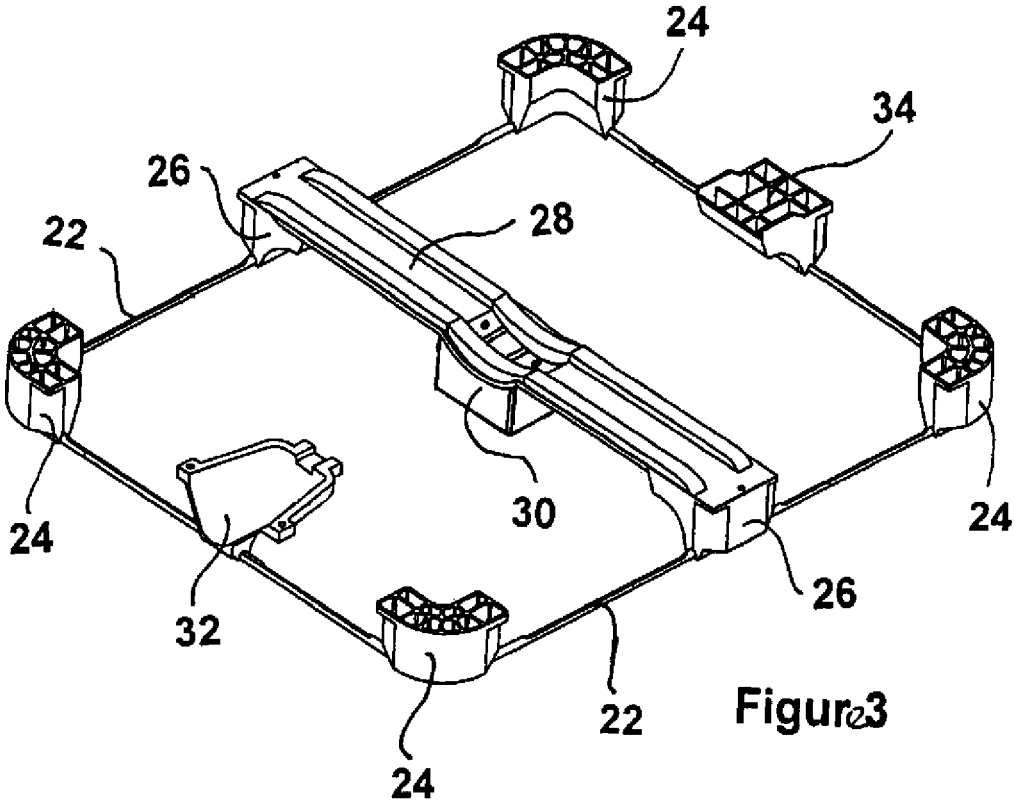

FIG. 2 shows an isometric view of a so-called combi-pallet (composite pallet). This composite pallet 16 has an upper deck 18 made of profiled steel sheet and a substructure 20 made of several spacers, involving plastic feet 24, 26, 30, 34 with a lower wrap-around steel tube 22 or plastic runners 36, 38. The substructure 20 of the composite pallet is illustrated in FIG. 3 without the upper deck. Four corner feet 24, four center feet 26, and a traverse bar 28 made of profiled steel sheet with an innermost center foot 30 are attached on the lower peripheral steel tube 22. All the feet 24, 26, 30 are manufactured of thermoplastic material (HD-PE=High Density Poly Ethylene) by injection molding. The plastic center foot 32, which is disposed on the front short pallet side below the outlet fitting, is formed as a drip pan. The center foot 34 (=of electrically conducting plastic) preferred for the present embodiment of the invention is arranged on the rear short side of the pallet confronting the outlet fitting.

The corner feet 24 and the center foot 32 configured as a drip pan should basically not be made of electrically conducting plastic (without carbon black) and only one or several of the center feet 26, 34 and/or the innermost center foot 30 at the center underneath the traverse bar 28 should be made of electrically conducting plastic (with carbon black).

Figure 4:
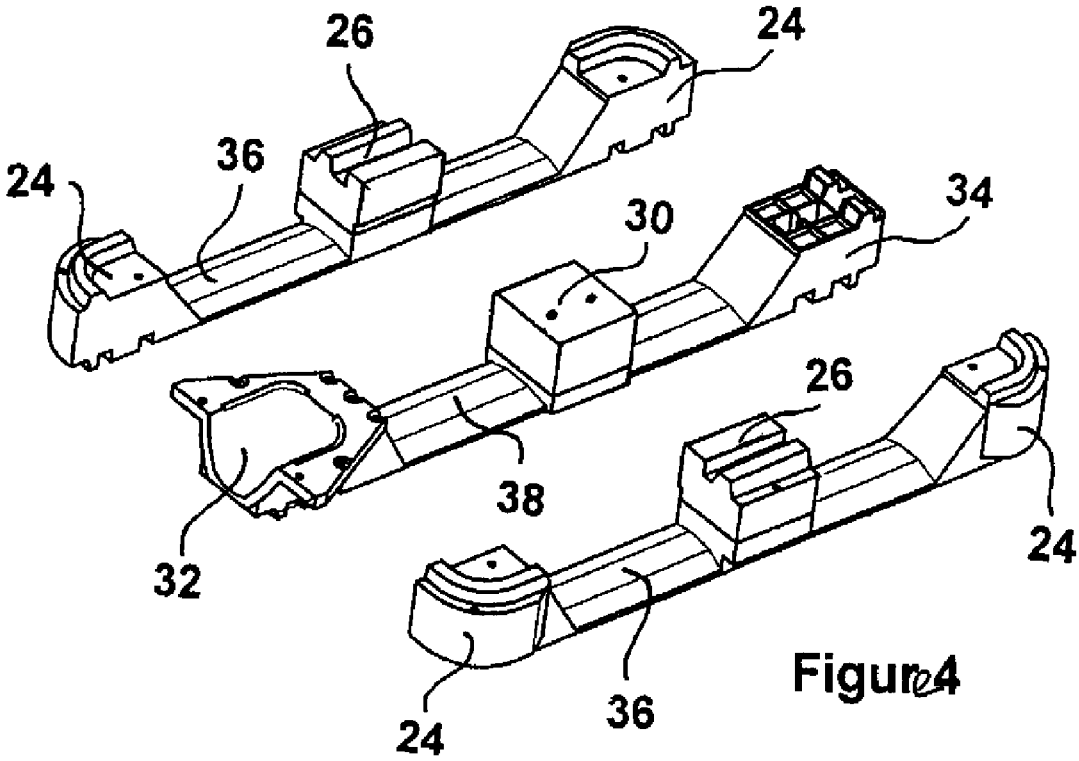

FIG. 4 shows the substructure of a bottom pallet configured as runner pallet. The outer runners 36, the center runner 38 and the individual corner feet 24 and the center feet 26, 30, 34 are also produced from HD-PE by injection molding. The runners can here be formed together with the corner and center feet as a single piece in one operation or as separate components. In any case, the outer runners 36 should be made of non-electrically conducting plastic (without carbon black) and only the center runner 38 should be made of electrically conducting plastic (with carbon black), whereas the plastic center foot 32 configured as a drip pan underneath the outlet fitting is made of non-electrically conducting plastic and glued, screwed on or otherwise, optionally exchangeable, attached to the center runner 38.

In a modified embodiment, only the rear center foot 34 may be formed of electrically conducting plastic, whereas the center runner 38 is made of non-electrically conducting plastic. The center foot 34 is here also glued, screwed or otherwise replaceably attached.

According to another embodiment, any one plastic runner 38 or plastic foot 26, 34 made of electrically conductive plastic material may be enclosed, as viewed in the longitudinal or transverse direction, by two plastic runners 36 or plastic feet 24 that are made of plastic material which is not electrically conductive.

Figure 5:
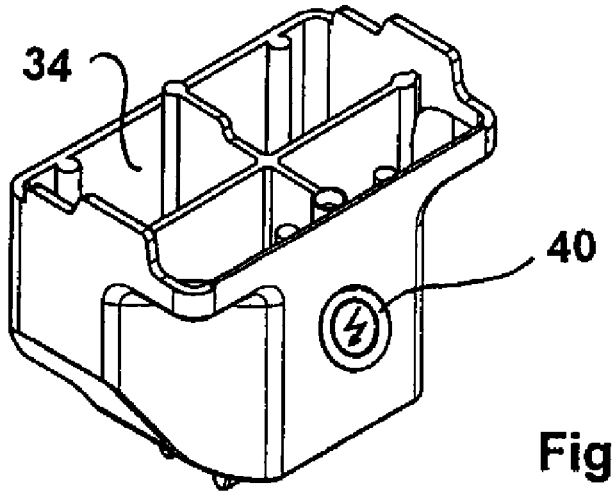

FIG. 5 shows again the plastic center foot 34 with a special impressed marking 40 which indicates that this plastic foot 34 is electrically conducting. In this way, the entire pallet 10 is electrically conducting and altogether electrically grounded. To safely ground the entire pallet container, it is generally sufficient to fabricate only one plastic foot or plastic runner of electrically conducting plastic containing carbon black. This saves the greatest quantity of expensive carbon black, so that only a small amount of carbon black has to be incorporated in a comparatively small quantity of plastic (less complex machining, smaller extruder, etc.).

The variant of the bottom pallet 16 depicted in FIG. 2 with wrap-around steel tube 24 underneath the plastic feet is not only advantageous for increasing the stability of the pallet, but guarantees also that the entire pallet container is always safely grounded even if the ground supporting the pallet is uneven.

A pallet container with the structure is suitable for Ex1 areas and meets the current transport regulations for contents of the hazard class 3 with a flashpoint below 61° C.

What is claimed is:

1. A pallet for a pallet container for storing and transporting liquid contents, in particular flammable or explosive contents, said pallet comprising:

an upper deck constructed of profiled sheet steel; and a substructure below the upper deck and including a plurality of spacers selected from the group consisting of plastic feet and plastic runners; and wherein less than half of the spacers are made of electrically conductive plastic material and more than half of the spacers are made of plastic material which is not electrically conductive, wherein a first plurality of the plastic feet are placed respectively at corners of the substructure to define corner feet made of plastic material which is not electrically conductive, and a second plurality of plastic feet are placed between the corner feet to define center feet, wherein at least one of the center feet is made of electrically conductive plastic material, and wherein first runners of the plastic runners are placed at an outer boundary of the substructure to define outer runners made of plastic material which is not electrically conductive.

2. The pallet of claim 1, wherein a second runner of the plastic runners is placed between the outer runners to define a center runner which is made of electrically conductive plastic material.

3. The pallet of claim 1, wherein the second plurality of plastic feet are made of electrically conductive plastic material, and wherein the outer runners or the corner feet including at least one of the center feet below an outlet fitting of a plastic inner container supported on the upper deck are made of plastic material which is not electrically conductive.

4. The pallet of claim 1, wherein outer ones of the center feet in two opposing sidewalls are made of electrically conductive plastic material, with the corner feet and remaining ones of the center feet being located below an outlet fitting of a plastic inner container supported on the pallet and made of plastic material which is not electrically conductive.

5. The pallet of claim 1, wherein one of the center feet is arranged in a sidewall distal to an outlet fitting of a plastic inner container supported on the pallet and made of electrically conductive plastic material, and another one of the center feet is arranged between outer ones of the center feet in midsection of the substructure and made of electrically conductive plastic material, with remaining ones of the center feet made of plastic material which is not electrically conductive.

6. The pallet of claim 1, wherein one of the center feet is arranged in a sidewall distal to an outlet fitting of a plastic inner container supported on the pallet and made of electrically conductive plastic material, with remaining ones of the center feet, including one of the center feet arranged between outer ones of the center feet in midsection of the substructure below the outlet fitting of the plastic inner container, being made of plastic material which is not electrically conductive.

7. The pallet of claim 1, wherein one of the center feet arranged distal to any one of side edges of the pallet is made of electrically conductive plastic material, with remaining ones of the center feet disposed along the side edges of the pallet being made of plastic material which is not electrically conductive.

8. The pallet of claim 1, wherein, as viewed in a longitudinal or transverse direction of the pallet, each spacer made of electrically conductive plastic material is enclosed by two spacers which are made of plastic material which is not electrically conductive.

9. The pallet of claim 1, wherein each of the spacers made of electrically conductive plastic material includes a marking indicating its electrically conductive property.

10. The pallet of claim 1, wherein the substructure includes a wrap-around steel pipe secured to an underside of outer ones of the plastic feet for increasing mechanical stability of the pallet and grounding the pallet.

11. The pallet of claim 1, wherein at least one spacer made of electrically conductive plastic material contains carbon black for grounding the pallet.

* * * * *